US011174730B2

(12) United States Patent
Sun et al.

(10) Patent No.: US 11,174,730 B2
(45) Date of Patent: Nov. 16, 2021

(54) FROST-RESISTANT ASSEMBLED INITIAL SUPPORT STRUCTURE OF TUNNEL AND CONSTRUCTION METHOD THEREOF

(71) Applicant: Southwest Jiaotong University, Chengdu (CN)

(72) Inventors: Keguo Sun, Chengdu (CN); Weiping Xu, Chengdu (CN); Zhifei Xiao, Chengdu (CN); Yuchao Zheng, Chengdu (CN); Mingzhao Yu, Chengdu (CN); Jinhang Qin, Chengdu (CN)

(73) Assignee: SOUTHWEST JIAOTONG UNIVERSITY, Chengdu (CN)

( * ) Notice: Subject to any disclaimer, the term of this patent is extended or adjusted under 35 U.S.C. 154(b) by 134 days.

(21) Appl. No.: 16/726,831

(22) Filed: Dec. 25, 2019

(65) Prior Publication Data

US 2020/0217200 A1 Jul. 9, 2020

(30) Foreign Application Priority Data

Jan. 8, 2019 (CN) ..... 201910014775.7

(51) Int. Cl.
*E21D 11/00* (2006.01)

(52) U.S. Cl.
CPC ..... *E21D 11/00* (2013.01)

(58) Field of Classification Search
CPC ..... E02D 11/00
USPC .... 405/150.1–152, 272, 273, 282, 283, 288, 405/289, 302.5
See application file for complete search history.

(56) References Cited

U.S. PATENT DOCUMENTS 3,169,376 A * 2/1965 Cunningham ..... E21D 11/10 405/150.1
3,509,725 A * 5/1970 Schnabel, Jr. ..... E21D 11/10 405/150.1
3,750,407 A * 8/1973 Heierli et al. ..... E21D 11/10 405/138
3,864,921 A * 2/1975 Marx et al. ..... E02D 17/08 405/265

FOREIGN PATENT DOCUMENTS

JP 2004011134 A * 1/2004 ..... E21D 11/00

* cited by examiner

*Primary Examiner* — Tara Mayo-Pinnock
(74) *Attorney, Agent, or Firm* — Bayramoglu Law Offices LLC

(57) ABSTRACT

The frost-resistant assembled initial support structure of the tunnel for supporting a surrounding rock includes a bearing layer, an elastic compressible structure and an inflatable airbag. A gap space is formed between the bearing layer and the surrounding rock, and the inflatable airbag and the elastic compressible structure are provided in the gap space; and the inflatable airbag after being inflated and the elastic compressible structure jointly fill up the gap space. A construction method includes providing the bearing layer in the tunnel, and forming the gap space between the bearing layer and the surrounding rock; providing the inflatable airbag and the elastic compressible structure in the gap space; and inflating the inflatable airbag and filling up the gap space with the inflatable airbag and the elastic compressible structure.

14 Claims, 2 Drawing Sheets

FROST-RESISTANT ASSEMBLED INITIAL SUPPORT STRUCTURE OF TUNNEL AND CONSTRUCTION METHOD THEREOF

CROSS REFERENCE TO THE RELATED APPLICATIONS

This application is based upon and claims priority to Chinese Patent Application No. 201910014775.7, filed on Jan. 8, 2019, the entire contents of which are incorporated herein by reference.

TECHNICAL FIELD

The present disclosure relates to the technical field of engineering, and more specifically to a frost-resistant assembled initial support structure of a tunnel and a construction method thereof used in high-latitude and high-altitude areas.

BACKGROUND

In China, the widespread cold regions account for 70% of the territory, and is located over the northern high-latitude areas and the western high-altitude areas. China's railways and highway networks are developing from east to west and from south to north with the expanding development of the western region in China. These regions are located in high-latitude or high-altitude areas, which often have seasonally frozen soil as a result of extreme weather conditions. The construction of tunnels in these regions have the possibility of frost damage, and the tunnel lining is affected by the freeze-thaw cycles of groundwater in the surrounding rock, and cracks continually appear, causing the reduction in service life and creating safety concerns.

Currently, in order to prevent the frost damage to a tunnel, an externally attached or intermediate thermal insulation layer is generally provided on the lining of the tunnel. It is difficult to ensure that the lining and surrounding rock are in the geothermal state because the externally attached thermal insulation layer is easily replaceable, but the thermal insulation effect is not ideal and the durability is poor. The intermediate thermal insulation layer is a disposable thermal insulation layer having a thermal insulation effect better than that of the externally attached thermal insulation layer. However, once the intermediate thermal insulation layer is damaged, it will not be repaired and replaced, thereby aggravating the frost damage. Solving the problem of frost damage to a tunnel is important for improving transportation related construction in high-latitude and high-altitude areas.

SUMMARY

The objective of the present disclosure is to provide a frost-resistant assembled initial support structure of a tunnel and a construction method thereof, which can effectively improve the technical problem of frost damage of tunnels in high-latitude and high-altitude seasonally frozen soil areas. The frost-resistant assembled initial support structure of a tunnel has the characteristics of simple structure, convenient operation and fast assembling speed, thus resulting in significant economic benefits.

Another objective of the present disclosure is to provide a construction method based on the frost-resistant assembled initial support structure of a tunnel, which can conveniently and quickly provide support to the tunnel, and ensures that the construction progress and construction quality is high.

Embodiments of the present disclosure are implemented by the following technical solutions.

A frost-resistant assembled initial support structure of a tunnel, for supporting a surrounding rock, includes:

a bearing layer, an elastic compressible structure and an inflatable airbag;

a gap space is formed between the bearing layer and the surrounding rock, and the inflatable airbag and the elastic compressible structure are provided in the gap space; and the inflatable airbag after being inflated and the elastic compressible structure jointly fill up the gap space.

Upon excavating the tunnel, the bearing layer is placed in the tunnel, and the inflatable airbag is placed in the tunnel face side of the bearing layer. After the inflatable airbag is inflated, the bearing layer, the surrounding rock, and the inflatable airbag form a closed space. Since excavated surface of the tunnel has uneven surface as a result of blasting operation, and there is freeze-thaw cycles of groundwater in the surrounding rock during the operation of the tunnel, the compressible material is pressed into and fills up the space formed by the inner surface of the bearing layer and the excavation surface. The process is repeated continuously to complete the construction of the initial support of a single footage. In the initial support structure, the bearing layer is used for overall force-bearing and support, the inflatable airbag is used for sealing the end, and the elastic compressible structure achieves overall frost resistance and yielding support.

During low temperature conditions in winter, the groundwater in the surrounding rock of the high-latitude and high-altitude seasonally frozen soil areas freezes and expands, so that the elastic compressible structure filled up between the bearing layer and the surrounding rock is compressed, thus causing a reduction in volume. In summer, the temperature of the surrounding rock rises, the ice in the surrounding rock thaws and drains, thus allowing the elastic compressible structure to return to its original state. The elastic compressible structure properly transfers the expansion pressure applied to the lining after the groundwater is frozen in the original freeze-thaw cycle, and converts the frost prevention to frost resistance. The present disclosure solves the problems of poor frost damage prevention and high maintenance cost of tunnels in high-latitude and high-altitude areas, and can provide technical guidance and reference for the frost resistance design and construction of the tunnels in high-latitude and high-altitude areas.

In one embodiment of the present disclosure:

the above-mentioned bearing layer includes a plurality of assembly units jointed to each other; and the plurality of assembly units are encircled to form a closed annular structure.

In one embodiment of the present disclosure:

the above-mentioned elastic compressible structure includes a plurality of elastic pellets.

In one embodiment of the present disclosure:

the plurality of elastic pellets have different sizes; and the elastic pellets of different sizes are arranged according to a preset gradation.

In one embodiment of the present disclosure:

the above-mentioned elastic pellets are made of rubber materials.

In one embodiment of the present disclosure:

the above-mentioned bearing layer is a double-curvature arch bearing layer with high rigidity.

In one embodiment of the present disclosure:

a sidewall of the bearing layer is provided with a through filling port; and the elastic compressible structure is provided in the gap space through the filling port.

In one embodiment of the present disclosure:

the above-mentioned frost-resistant assembled initial support structure of the tunnel further includes a pressure device; and the pressure device fills a gap outside the inflatable airbag in the gap space with the elastic compressible structure until filling up the gap.

A construction method based on the frost-resistant assembled initial support structure of the tunnel of any one of the above embodiments, including the following steps:

providing the bearing layer in the tunnel, and forming the gap space between the bearing layer and the surrounding rock;

providing the inflatable airbag and the elastic compressible structure in the gap space; and inflating the inflatable airbag and filling up the gap space with the inflatable airbag and the elastic compressible structure.

The construction method can ensure the structural stability and the quality reliability of the frost-resistant assembled initial support structure of the tunnel, thereby obtaining a support structure with characteristics of self-absorption ability of frost heaving force, good frost resistance performance, good durability and strong self-deformation capability.

In one embodiment of the present disclosure:

specific dimensions and quantities of the assembly units are determined according to the design dimensions, the reserved deformation amount and the flatness of the excavation face of the tunnel;

the elastic compressible structure and the inflatable airbag are synchronously manufactured by a factory;

the above-mentioned construction method further includes the following steps: fixing a qualified inflatable airbag at an end side of the assembly units at the tunnel entrance; after the tunnel is excavated, assembling the assembly units from bottom to top, and enclosing the assembly units to form the bearing layer; inflating and pressurizing the inflatable airbag, wherein a sealed space is formed by the inflatable airbag, the bearing layer and the surrounding rock; pressing the elastic compressible material into the sealed space by the pressure device; filling up the sealed space; and closing the filling port to complete the construction of the support structure; and starting a next excavation cycle and installing a corresponding initial support structure.

The technical solutions of the embodiments of the present disclosure have at least the following advantages:

In the frost-resistant assembled initial support structure of the tunnel, the bearing layer is used for overall force-bearing and support, the inflatable airbag is used for sealing the end, and the elastic compressible structure achieves overall frost resistance and yielding support. Under the low temperature conditions in winter, the groundwater in the surrounding rock of the high-latitude and high-altitude seasonally frozen soil areas is frozen and expanded, thus causing compression of the elastic compressible structure filled up between the bearing layer and the surrounding rock. This compression of the elastic compressible structure causes a reduction in volume. In summer, the temperature of the surrounding rock rises, the ice thaws and drains, and the elastic compressible structure is restored to its original state. The elastic compressible structure properly transfers the expansion pressure applied to the lining after the groundwater is frozen in the original freeze-thaw cycle, and changes the frost prevention to frost resistance. The present disclosure solves the problems of poor frost damage prevention effect and high maintenance cost of tunnels in high-latitude and high-altitude areas, and can provide technical guidance and reference for the frost resistance design and construction of the tunnels in high-latitude and high-altitude areas.

BRIEF DESCRIPTION OF THE DRAWINGS

In order to illustrate the technical solutions of the embodiments of the present disclosure more clearly, a brief introduction to the drawings with reference to the embodiments is presented below. It should be understood that the drawings described below are merely some of the embodiments of the present disclosure and should not be construed as limiting the scope of protection. For an ordinary person skilled in the art, other drawings may be derived according to these drawings without creative efforts.

Figure 1:
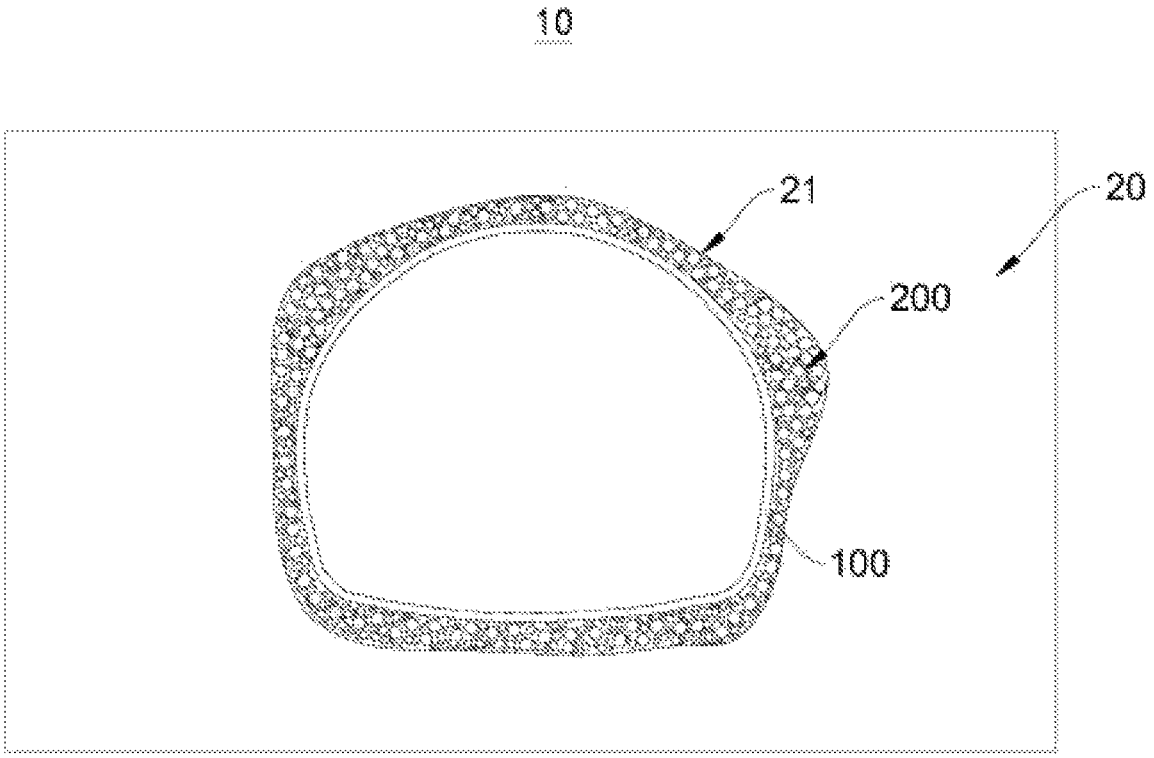
FIG. 1 is a schematic diagram showing a first structure of a frost-resistant assembled initial support structure of a tunnel according to an embodiment of the present disclosure.
Figure 2:
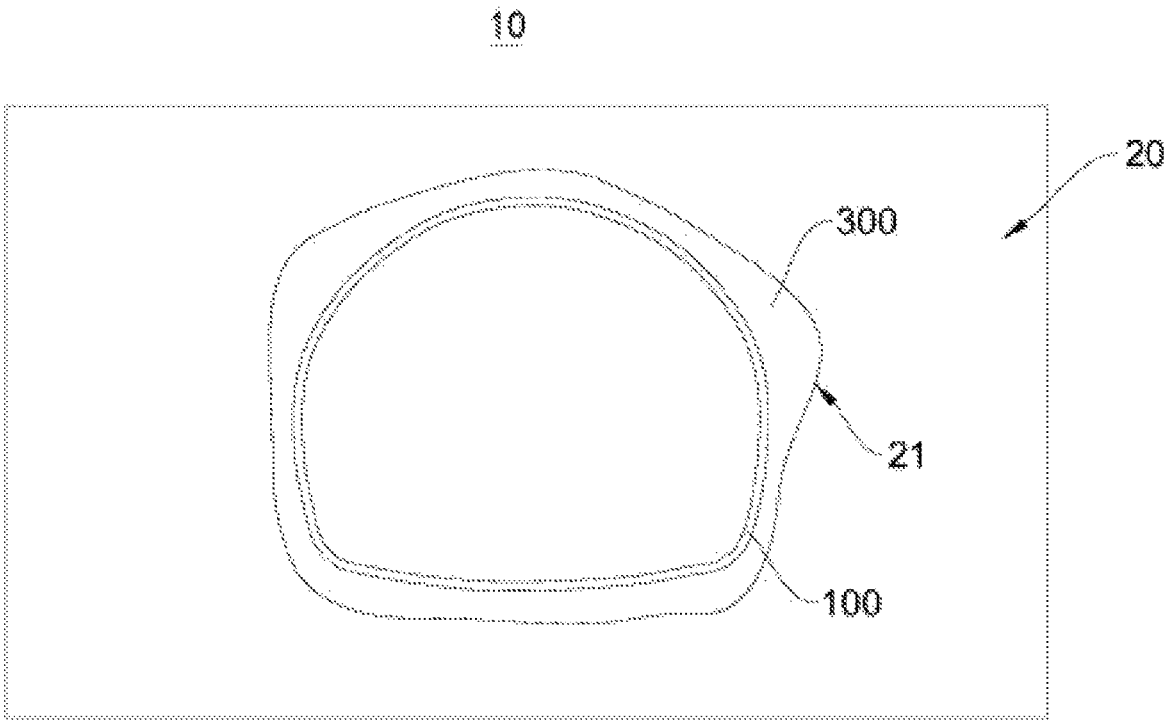
FIG. 2 is a schematic diagram showing a second structure of a frost-resistant assembled initial support structure of the tunnel according to an embodiment of the present disclosure.
Figure 3:
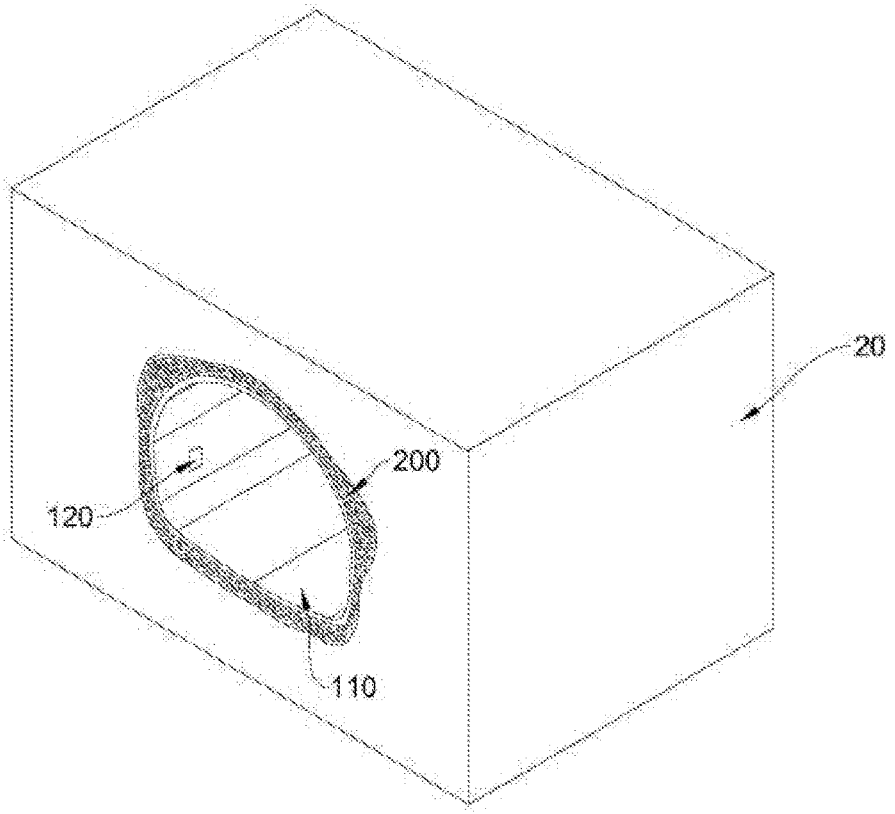
FIG. 3 is a schematic diagram showing a third structure of a frost-resistant assembled initial support structure of the tunnel according to an embodiment of the present disclosure.
Figure 4:
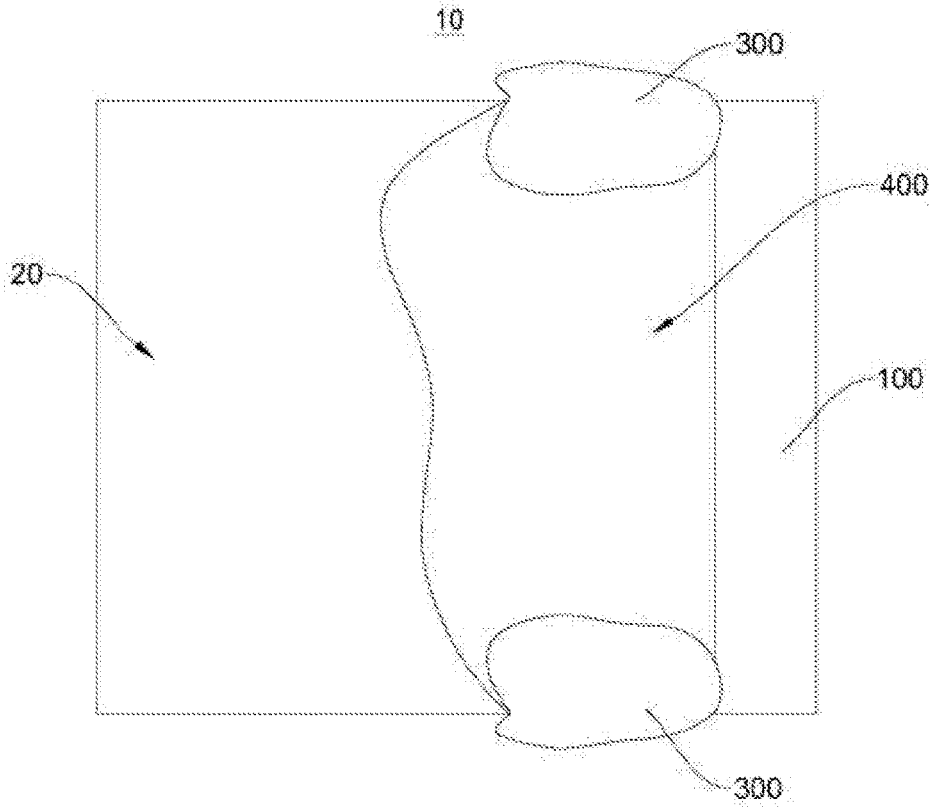
FIG. 4 is a schematic diagram showing a fourth structure of a frost-resistant assembled initial support structure of the tunnel according to an embodiment of the present disclosure.

Reference designators: 10—frost-resistant assembled initial support structure of tunnel; 100—bearing layer; 110—assembly unit; 120—filling port; 200—elastic compressible structure; 300—inflatable airbag; 400—gap space; 20—surrounding rock; 21—excavation face.

DETAILED DESCRIPTION OF THE EMBODIMENTS

In order to describe the objectives, technical solutions, and advantages of the embodiments of the present disclosure clearly, the technical solutions of the embodiments of the present disclosure are described hereinafter with reference to the drawings in the embodiments of the present disclosure. The described embodiments are a part of, and not all, the embodiments of the present disclosure. The components of the embodiments of the present disclosure, which are generally described and illustrated in the drawings herein, may be arranged and designed in various different configurations.

Accordingly, the following detailed description of embodiments of the present disclosure provided in the drawings is not intended to limit the scope of protection of the claimed disclosure, but merely to represent preferred embodiments of the present disclosure. Based on the embodiments of the present disclosure, all other embodiments obtained by those ordinary persons skilled in the art without creative efforts fall within the protection scope of the present disclosure.

It should be noted that similar reference numerals and letters indicate similar items in the following drawings, and therefore, once an item is defined in one drawing, there is no need for further definition and explanation of this item in the subsequent drawings.

In the description of the present disclosure, it should be noted that the terms such as "center", "upper", "lower", "left", "right", "vertical", "horizontal", "inside/internal", "outside/external" and others. indicate the locations or positional relationship based on the locations or positional relationship shown in the drawings, which are merely used to facilitate the description of the present disclosure and simplify the descriptions, rather than indicate or imply that the device or component referred must have a specific orientation, or must be constructed and operated in a specific orientation. Therefore, these terms cannot be interpreted as limiting the presented disclosure. In addition, the terms "first", "second" and "third" are merely used to distinguish a description and cannot be interpreted as indicating or implying relative importance.

In addition, the terms "horizontal", "vertical", "overhang" and others. do not mean that the component is required to be absolutely horizontal, vertical or overhanging, but may be inclined slightly. For example, "horizontal" simply means that the direction is more horizontal than "vertical", and does not mean that the structure must be completely horizontal, but may be inclined slightly.

In the description of the present disclosure, it should be further noted that, unless otherwise explicitly specified and limited, the terms such as "provide", "install", "interconnection", and "connection" shall be understood broadly. For example, it can be a fixed connection, a detachable connection, or an integrated connection. Alternatively, it can be a mechanical connection or an electrical connection. Also, it can be a direct connection or an indirect connection through an intermediate medium, or an interconnection between two components. The specific meaning of the above terms in the present disclosure should be understood according to the context by those ordinary person skilled in the art.

Construction of tunnels in high-latitude or high-altitude regions face the danger of frost damage due to seasonally frozen soil, where the tunnel lining is affected by the freeze-thaw cycles of groundwater in the surrounding rock, and cracks continually appear, thus reducing the service life of tunnel and creating safety concerns. At present, in order to prevent the frost damage to a tunnel, a method of providing an externally attached or intermediate thermal insulation layer on the lining is generally employed. The externally attached thermal insulation layer is easy to replace, but the thermal insulation effect is not ideal and weak, so it is difficult to ensure that the lining and surrounding rock are in a geothermal state. The intermediate thermal insulation layer is a disposable thermal insulation layer, and the thermal insulation effect is better than that of the externally attached thermal insulation layer. However, once the intermediate thermal insulation layer is damaged, it cannot be repaired and replaced, thereby aggravating the frost damage.

Embodiment 1

In order to overcome the above problems, the frost-resistant assembled initial support structure 10 of the tunnel is provided in the following embodiment.

FIG. 1 is a schematic diagram showing a structure of the frost-resistant assembled initial support structure 10 of the tunnel according to an embodiment of the present disclosure. As shown in FIG. 1, the frost-resistant assembled initial support structure 10 of the tunnel is used to support the surrounding rock 20, including the bearing layer 100, the elastic compressible structure 200, and the inflatable airbag 300.

The gap space 400 is provided between the bearing layer 100 and the surrounding rock 20, and the inflatable airbag 300 and the elastic compressible structure 200 are provided in the gap space.

The inflatable airbag 300 after being inflated and the elastic compressible structure 200 jointly fill up the gap space 400.

During use, after the tunnel is excavated, the bearing layer 100 is placed in the tunnel, and the inflatable airbag 300 is placed on a tunnel face side of the bearing layer 100. After the inflatable airbag 300 is inflated, the bearing layer 100, the surrounding rock 20 and the inflatable airbag 300 form a closed space. Due to the uneven state of the excavation face 21 after blasting and the freeze-thaw cycles of groundwater in the surrounding rock 20 during the operation of the tunnel, the elastic compressible structure 200 is pressed into and fills up the space formed by the inner surface of the bearing layer 100 and the excavation face 21. The process is repeated continuously to complete the construction of the initial support of a single footage. Specifically, the bearing layer 100 is used for overall force-bearing and support, the inflatable airbag 300 is used for end sealing, and the elastic compressible structure 200 achieves overall frost resistance and yielding support.

Under the low temperature conditions in winter, the groundwater in the surrounding rock 20 of the high-latitude and high-altitude seasonally frozen soil areas is frozen and expanded, so that the elastic compressible structure 200 filled up between the bearing layer 100 and the surrounding rock 20 is compressed, and the compressed elastic compressible structure 200 shrinks. In summer, the temperature of the surrounding rock 20 rises, the ice thaws and drains automatically, and the elastic compressible structure 200 is restored to its original state. The elastic compressible structure 200 properly transfers the expansion pressure applied to the lining after the groundwater is frozen in the original freeze-thaw cycle, and changes the frost prevention to frost resistance. The present disclosure solves the problems of poor frost damage prevention and high maintenance cost of tunnels in high-latitude and high-altitude areas, and offers technical guidance and reference by providing frost resistance design and construction of the tunnels in high-latitude and high-altitude areas. Furthermore, the frost-resistant assembled initial support structure 10 of the tunnel can also be used for general tunnels in non-alpine areas.

More details of the frost-resistant assembled initial support structure 10 of the tunnel are presented in FIGS. 1-4.

In the present embodiment, the inflatable airbag 300 is provided at the end of the bearing layer 100, and a gap between the end portion and the surrounding rock 20 is filled up by the inflatable airbag 300.

Further, in the present embodiment, the above-mentioned bearing layer 100 includes a plurality of assembly units 110 jointed to each other; and the plurality of assembly units 110 are encircled to form a closed annular structure 110. Optionally, the assembly units 110 of the bearing layer 100 are first processed according to the size at the factory, and on the construction site, the assembly units 110 are sequentially installed from the bottom to the top to form the closed annular bearing layer 100. Optionally, the bearing layer 100 is the double-curvature arch bearing layer 100 with high rigidity.

Optionally, the above-mentioned elastic compressible structure 200 includes a plurality of elastic pellets. In the present embodiment, the above-mentioned elastic pellets are made of rubber materials.

It should be noted that, in other embodiments of the present disclosure, the elastic compressible structure 200 may also be an expanded elastic element, which is merely exemplary herein, as long as the elastic compressible structure 200 has the characteristics of self-absorption ability of frost heaving force, good frost resistance performance, good durability and strong self-deformation capability. Similarly, in other embodiments of the present disclosure, the elastic pellets may be made of other materials having elastic force, and are not excessively limited herein.

Further, in the present embodiment, the plurality of elastic pellets mentioned above have different sizes; and the elastic pellets of different sizes are arranged according to a preset gradation. The grading of the elastic pellets can facilitate filling the gap between the bearing layer 100, the surrounding rock 20, and the inflatable airbag 300 to form a closed space.

Further, a sidewall of the above-mentioned bearing layer 100 is provided with the through filling port 120; and the elastic compressible structure 200 is provided in the gap space 400 through the filling port 120.

Optionally, the frost-resistant assembled initial support structure of tunnel 10 further includes a pressure device (not shown in the drawings). The pressure device fills up the gap outside the inflatable airbag 300 in the gap space 400 with the elastic compressible material.

During use, the bearing layer 100 is first processed according to the size at the factory, and the filling port 120 is prefabricated to form the assembly unit 110 for assembling, and the elastic compressible structure 200 and the inflatable air bag 300 having a certain gradation are manufactured.

Installation and construction on site are as follows. The inflatable airbag 300 is fixed at the end side of the assembly units at the tunnel entrance. After the tunnel is excavated, the assembly units 110 are installed in sequence from bottom to top by using a mounting machine to form a closed loop. The airbag is inflated and pressurized, so that the bearing layer 100, the surrounding rock 20, and the inflatable airbag 300 form a sealed space. A sufficient amount of the elastic compressible material is pressed into and fills up the sealed space by the pressure device, and then the filling port 120 is closed to accomplish the construction of the initial support of the single footage. The excavation work of the next footage is carried out, the support unit of the footage is installed, and the process is repeated continuously to complete the construction of the entire tunnel.

During the on-site use, the structure has the advantages of self-absorption ability of frost heaving force, good frost resistance performance, good durability and strong self-deformation capability. Compared with the traditional frost-resistant support structure with thermal insulation layer, the specific functions and advantages of the frost-resistant assembled initial support structure of tunnel are as follows:

(1) Frost resistance: The seasonally frozen soil damages to tunnel lining mainly in the manner of the damage of freeze-thaw cycle. Under the low temperature conditions in winter, the groundwater in the surrounding rock 20 is frozen and expanded, so that the elastic compressible structure 200 filled up between the bearing layer and the surrounding rock is compressed, and the compressed elastic compressible structure 200 shrinks. In summer, the temperature of the surrounding rock 20 rises, the ice thaws, and the elastic compressible structure is restored to the original state. The elastic compressible structure 200 properly transfers the expansion pressure applied to the lining after the groundwater is frozen in the original freeze-thaw cycle, and changes the frost prevention to frost resistance.

(2) Self-deformation capability: A sufficient amount of the elastic compressible structure 200 can fill up the over-break portion of the excavation face 21. On the one hand, the double-curvature arch bearing layer 100, the elastic compressible structure 200 and the surrounding rock 20 form an integral force-bearing structure, so that the supporting structure is stressed as soon as possible, and steps such as grouting are avoided; and on the other hand, after the excavation of the tunnel, the deformation pressure of the surrounding rock 20 can be borne by the elastic compressible structure 200, and the elastic compressible structure 200 is further compacted by the pressure, so that the stress after excavation is released by the surrounding rock 20.

(3) Construction speed: Since the tunnel construction belongs to the circular operation project of the single tunnel face, the manner of the factory manufacture and on-site assembly can greatly reduce the time for the construction of the support structure, and significantly accelerate the construction speed. The on-site installation can be carried out by the large-scale machinery, which has a high speed, high efficiency, less demand for personnel, and low safety risk, and confirms the current mainstream of green and environmentally friendly construction technology.

(4) Construction Cost: The assembly unit 110, the elastic compressible structure 200 and the inflatable airbag 300 can be synchronously manufactured at the factory. Compared with the anti-frost thermal insulation layer, the elastic compressible structure 200 and the inflatable airbag 300 have advantages of wide-ranging raw materials, low cost, and good durability. Moreover, the on-site installation does not require shotcrete, so the working environment of the tunnel face is obviously improved, the air volume required is reduced, and the cost is cut down.

Embodiment 2

The present embodiment provides a construction method (not shown in the drawings), which is based on the frost-resistant assembled initial support structure of the tunnel of the Embodiment 1. The construction method includes the following steps:

the bearing layer is provided in the tunnel, and a gap space is formed between the bearing layer and the surrounding rock;

the inflatable airbag and the elastic compressible structure are provided in the gap space; and the gap space is filled up by the inflatable airbag after being inflated and the elastic compressible structure.

Through the construction method, the structural stability and the quality reliability of the frost-resistant assembled initial support structure of the tunnel can be ensured, thereby obtaining a support structure with characteristics of self-absorption ability of frost heaving force, good frost resistance performance, good durability and strong self-deformation capability.

Specifically, the construction method includes the following steps:

the specific dimensions and quantities of the assembly units are determined according to the design dimensions, the reserved deformation amount and the flatness of the excavation face of the tunnel;

the elastic compressible structure and the inflatable airbag are synchronously manufactured by the factory;

the qualified inflatable airbag is fixed at the end side of the assembly units at the tunnel entrance; after the tunnel is excavated, the assembly units are assembled from bottom to top, and the assembly units are encircled to form the bearing layer; the inflatable airbag is inflated and pressurized, then a sealed space is formed by the inflatable airbag, the bearing layer and the surrounding rock; the elastic compressible structure is pressed into the sealed space by using the pressure device, and the sealed space is filled up; and the filling port is closed to complete the construction of the support structure; and a next excavation cycle starts and a corresponding support structure is installed.

The technical solutions of the embodiments of the present disclosure have at least the following advantages and beneficial effects:

In the frost-resistant assembled initial support structure of the tunnel, the bearing layer is used for overall force-bearing and support, the inflatable airbag is used for end sealing, and the elastic compressible structure achieves overall frost resistance and yielding support. Under the low temperature environment in winter, the groundwater in the surrounding rock of the high-latitude and high-altitude seasonally frozen soil areas is frozen and expanded, thus causing compression of the elastic compressible structure filled up between the bearing layer and the surrounding rock. This compression of the elastic compressible structure causes a reduction in volume. In summer, the temperature of the surrounding rock rises, the ice thaws and drains automatically, and the elastic compressible structure is restored to the original state. The elastic compressible structure properly transfers the expansion pressure applied to the lining after the groundwater is frozen in the original freeze-thaw cycle, and changes the frost prevention to frost resistance. The present disclosure solves the problems of poor frost damage prevention and high maintenance cost of tunnels in high-latitude and high-altitude areas, and can provide technical guidance and reference for the frost resistant design and construction of the tunnels in high-latitude and high-altitude areas.

The foregoing descriptions are merely preferred embodiments of the present disclosure, which are not intended to limit the present disclosure. For those ordinary persons skilled in the art, various modifications and changes can be made according to the present disclosure. Any modifications, equivalent substitutions, improvements, etc. made within the spirit and principles of the present disclosure should be included in the scope of protection of the present disclosure.

What is claimed is:

1. A frost-resistant assembled initial support structure of a tunnel for supporting a surrounding rock, comprising:

a bearing layer, an elastic compressible structure and an inflatable airbag; wherein, a gap space is formed between the bearing layer and the surrounding rock, and the inflatable airbag and the elastic compressible structure are provided in the gap space; and the inflatable airbag after being inflated and the elastic compressible structure jointly fill up the gap space; wherein, the elastic compressible structure comprises a plurality of elastic pellets;

the plurality of elastic pellets have different sizes; and the plurality of elastic pellets having different sizes are arranged according to a preset gradation.

2. The frost-resistant assembled initial support structure of the tunnel according to claim 1, wherein, the bearing layer comprises a plurality of assembly units jointed to each other; and the plurality of assembly units are encircled to form a closed annular structure.

3. The frost-resistant assembled initial support structure of the tunnel according to claim 1, wherein, the plurality of elastic pellets are made of rubber materials.

4. The frost-resistant assembled initial support structure of the tunnel according to claim 1, wherein, the bearing layer is a double-curvature arch bearing layer with high rigidity.

5. The frost-resistant assembled initial support structure of the tunnel according to claim 1, wherein, a sidewall of the bearing layer is provided with a through filling port; and the elastic compressible structure is provided in the gap space through the through filling port.

6. The frost-resistant assembled initial support structure of the tunnel according to claim 1, further comprising a pressure device; wherein, the pressure device fills a gap outside the inflatable airbag in the gap space with the elastic compressible structure until filling up the gap.

7. A construction method based on a frost-resistant assembled initial support structure of a tunnel comprising a bearing layer, an elastic compressible structure and an inflatable airbag; wherein, a gap space is formed between the bearing layer and the surrounding rock, and the inflatable airbag and the elastic compressible structure are provided in the gap space; and the inflatable airbag after being inflated and the elastic compressible structure jointly fill up the gap space; wherein the construction method comprises the following steps:

providing the bearing layer in the tunnel, and forming the gap space between the bearing layer and the surrounding rock;

providing the inflatable airbag and the elastic compressible structure in the gap space; and inflating the inflatable airbag and filling up the gap space with the inflatable airbag and the elastic compressible structure; wherein, the bearing layer comprises a plurality of assembly units jointed to each other; and the plurality of assembly units are encircled to form a closed annular structure.

8. The construction method according to claim 7, further comprising the following steps:

determining specific dimensions and quantities of the plurality of assembly units according to design dimensions, a reserved deformation amount and a flatness of an excavation face of the tunnel;

synchronously manufacturing the elastic compressible structure and the inflatable airbag in a factory;

fixing a qualified inflatable airbag at an end side of the assembly unit at an entrance of the tunnel; after an excavation of the tunnel, assembling the plurality of assembly units from bottom to top, and enclosing the plurality of assembly units to form the bearing layer; inflating and pressurizing the inflatable airbag, wherein a sealed space is formed by the inflatable airbag, the bearing layer and the surrounding rock; pressing the elastic compressible structure into the sealed space by the pressure device, filling up the sealed space, and closing the through filling port to complete the construction of the support structure; and starting a next excavation cycle and installing a corresponding support structure.

9. The construction method according to claim 7, wherein, the elastic compressible structure comprises a plurality of elastic pellets.

10. The construction method according to claim 9, wherein, the plurality of elastic pellets have different sizes; and the plurality of elastic pellets having different sizes are arranged according to a preset gradation.

11. The construction method according to claim 10, wherein, the plurality of elastic pellets are made of rubber materials.

12. The construction method according to claim 7, wherein, the bearing layer is a double-curvature arch bearing layer with high rigidity.

13. The construction method according to claim 7, wherein, a sidewall of the bearing layer is provided with a through filling port; and the elastic compressible structure is provided in the gap space through the through filling port.

14. The construction method according to claim 7, further comprising a pressure device; wherein, the pressure device fills a gap outside the inflatable airbag in the gap space with the elastic compressible structure until filling up the gap.

* * * * *